United States Patent [19]

Takano et al.

[11] Patent Number: 4,933,720

[45] Date of Patent: Jun. 12, 1990

[54] PAPER SIZE SELECTING DEVICE IN A RECORDING APPARATUS

[75] Inventors: Yoshiaki Takano; Tsuneo Kitagawa, both of Osaka, Japan

[73] Assignee: Minolta Camera Kabushiki Kaisha, Osaka, Japan

[21] Appl. No.: 196,131

[22] Filed: May 19, 1988

[30] Foreign Application Priority Data

May 22, 1987 [JP] Japan ..... 62-126780

[51] Int. Cl.[5] ..... G03G 15/00

[52] U.S. Cl. ..... 355/209; 355/311

[58] Field of Search ..... 355/203, 204, 206, 209, 355/309, 311

[56] References Cited

U.S. PATENT DOCUMENTS 4,406,537 9/1983 Mori ..... 355/311

4,598,994 7/1986 Tomosada et al. ..... 355/209 X 4,615,609 10/1986 Honma ..... 355/209 X 4,639,114 1/1987 Ide et al. ..... 355/309

4,804,997 2/1989 Mizude ..... 355/311

*Primary Examiner*—R. L. Moses

*Assistant Examiner*—Edward Pipala

*Attorney, Agent, or Firm*—Price, Gess & Ubell

[57] ABSTRACT

A paper size selecting device for use in a recording apparatus loadable with paper of different sizes selectively, which includes a detector for detecting the size of paper loaded in the apparatus, selecting key for selecting a desired size and a plurality of display members provided for the respective sizes of paper loadable in the apparatus. Each of the display members indicates that the paper of the size concerned is loaded in the apparatus as well as that the paper of the size concerned has been selected by the selecting key.

9 Claims, 8 Drawing Sheets

FIG.9

| detect code | size |
|---|---|
| 0 0 0 | — |
| 0 0 1 | A 3 |
| 0 1 0 | B 4 |
| 0 1 1 | A 4 |
| 1 0 0 | B 5 |
| | |

PAPER SIZE SELECTING DEVICE IN A RECORDING APPARATUS

BACKGROUND OF THE INVENTION

The present invention relates to a paper size selecting device having an improved size display for use in copying machines or printers.

Generally copying machines require paper of different sizes for copying various originals. For this purpose, known copying machines have paper cassettes which are different in the size of paper contained therein and which are removably attached to the machine body in a multiplicity of stages.

With such conventional copying machines, the desired paper is selected by depressing a paper selecting switch on the operation panel.

Even with these copying machines, the paper size display on the operation panel does not show the paper sizes of the cassettes currently attached to the machine body but indicates only the particular paper size specified by the selecting switch.

Thus, a problem arises in that the display fails to indicate whether the paper cassette for the paper size to be selected is attached to the machine body.

Accordingly, the operator must visually check the plurality of paper cassettes arranged one above another as attached to one side of the machine body to recognize whether the cassette containing the contemplated paper is present.

Alternatively, there arises a need to depress the paper selecting switch to recognize the display indicating that the cassette with the paper of desired size is set in position.

When originals of different sizes are to be copied in succession, copy paper of different sizes need to be used, so that every time copy paper of a different size is to be used, the paper size of cassettes must be checked by depressing the paper selecting switch. This results in a lower copying operation efficiency.

SUMMARY OF THE INVENTION

The main object of the present invention is to provide a paper size selecting device which readily indicates the selectable paper sizes when a particular paper size is to be selected so as to enable the operator to select the desired paper easily.

Another object of the invention is to provide a paper size selecting device which assures facilitated selection and enables the operator to manifestly identify the selected paper.

To fulfill these objects, the present invention provides a paper size selecting device for use in a recording apparatus loadable with paper of different sizes selectively, the device comprising means for detecting the size of paper loaded in the apparatus, key input means for selecting a desired size, a plurality of display members provided for the respective sizes of paper loadable in the recording apparatus, each of the display members being selectively operable in a first display state indicating that the paper of the size concerned is loaded in the recording apparatus or in a second display state indicating that the paper of the size concerned has been selected, and control means for bringing each of the display members into the first display state in response to an output from the size detecting means and changing over the display member from the first display state to the second display state in response to an output from the size selecting key input means.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

FIG. 9 is a diagram showing size detection codes assigned to paper cassettes for illustrative purposes.

DETAILED DESCRIPTION OF THE INVENTION

An embodiment of the invention will be described below with reference to the accompanying drawings.

Figure 1:
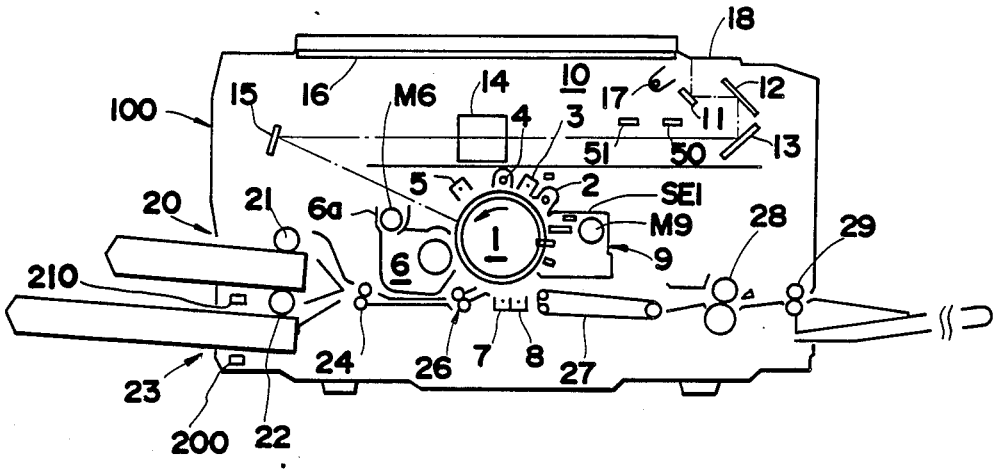
FIG. 1 is a schematic sectional view showing an example of electrophotographic copying machine to which the invention is applied.

With reference to FIG. 1, a photosensitive drum 1 is disposed in the center of the body of a copying machine 100 and is rotatable in the direction of arrow shown. Arranged around the drum 1 are an eraser 2, sensitizing charger 3, developing unit 6, transfer and separating chargers 7, 8, cleaner 9, etc.

Provided above the assembly of these components is an optical system 10 comprising an exposure lamp 17, mirrors 11, 12, 13 and 15, a projection lens 14, etc. When the optical system is not in the scan starting position, the system moves rightward to the illustrated scan starting position (subsequently, home position) with the start of copying operation, with the exposure lamp 17 preliminarily turned on.

The optical system thereafter moves leftward with the exposure lamp 17 fully turned on to scan an original placed on a document support glass plate 16, projecting an image of the original on the drum 1 and forming an electrostatic latent image on the drum surface sensitized by the charger 3.

On the other hand, a sheet of copy paper is sent out by a feed roller 21 or 22 from a paper cassette 20 or 23 containing copy paper of predetermined size and fed to the transfer station in synchronism with the image forming operation on the drum 1 by the travel of the optical system 10. The paper feed portion of the body of the copying machine is provided with paper size detecting circuits 210 and 200 for detecting the size of copy paper in the respective cassettes inserted in place.

Each of the detecting circuits 210, 200 has three switches which are suitably turned on or off by a contact provided on the rear side of the cassette to be inserted.

A paper cassette is prepared specifically for each of different paper sizes, and a contact or contacts are arranged on the cassette in accordance with the paper size code concerned as shown in FIG. 9.

Thus, the switches of each detecting circuit 210 or 200 are suitably turned on or off by the cassette installed, and the size of the paper in the cassette can be detected from the combination of the on and off states of the switches. For example, when the respective switches are off, on and off (0,1,0), the detecting circuit detects that the paper size is B4.

The latent image on the drum 1 is developed by the developing unit 6 to a toner image, which is then transferred by the transfer charger 7 onto the copy paper fed to the transfer station. The paper is thereafter separated from the drum 1 by the separating charger 8 and transported to a fixing unit 28, at which the toner image is fixed to the paper, whereupon the paper is discharged.

After the image transfer, the cleaner 9 removes the residual toner from the drum 1, and the eraser lamp 2 removes the residual charge therefrom, rendering the drum 1 ready for the subsequent copying cycle.

The copying machine 100 repeatedly performs the foregoing copying operation for the number of copies keyed in by the operator before the operation and is brought to a stop upon the lapse of a predetermined period of time thereafter.

Figure 3:
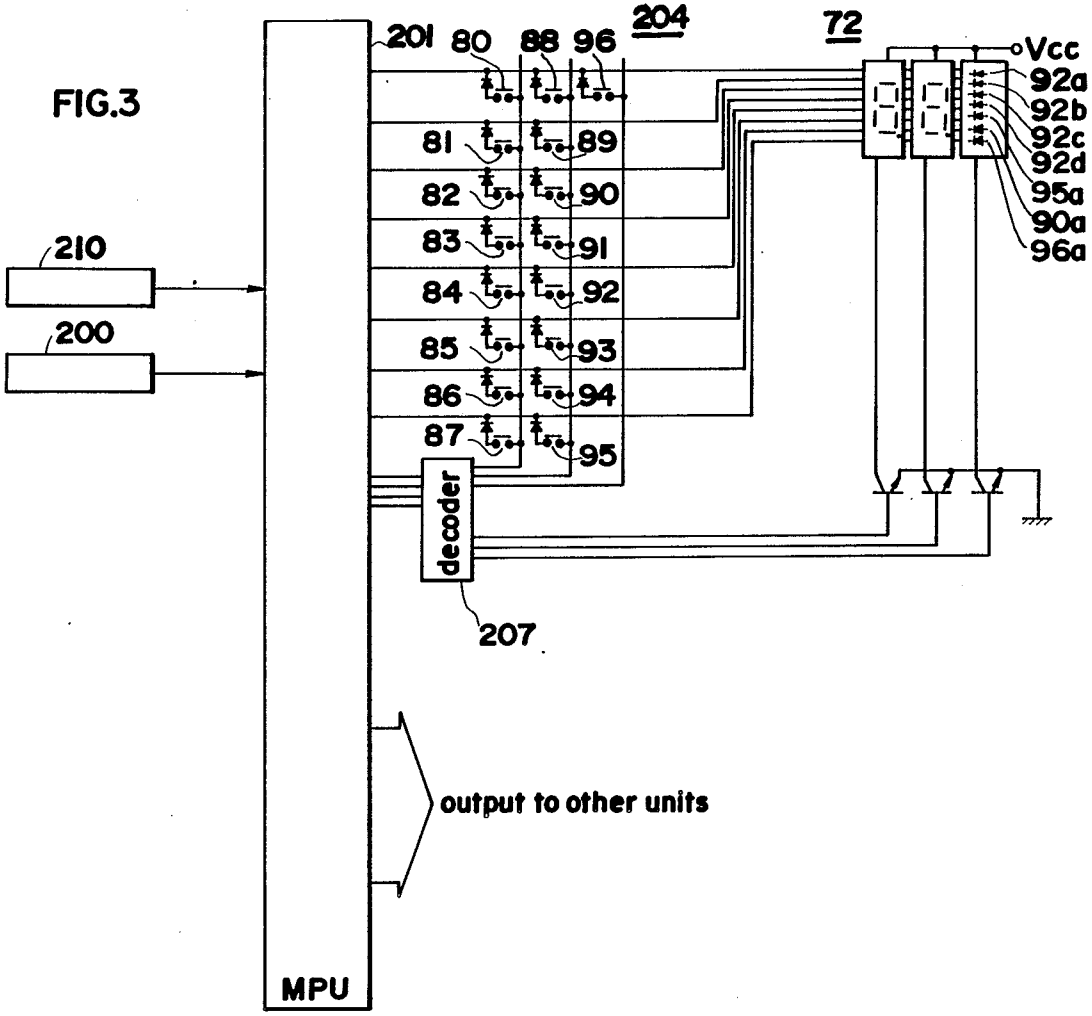
FIG. 3 is a circuit diagram of the copying machine.

The operation of the copying machine including the stopping thereof is controlled by a microcomputer (MPU) 201 and the peripheral circuit thereof (including a diode matrix circuit 204, decoder 207, display circuit 72, the paper size detecting circuits 100, 200, etc.) as shown in FIG. 3.

Figure 2:
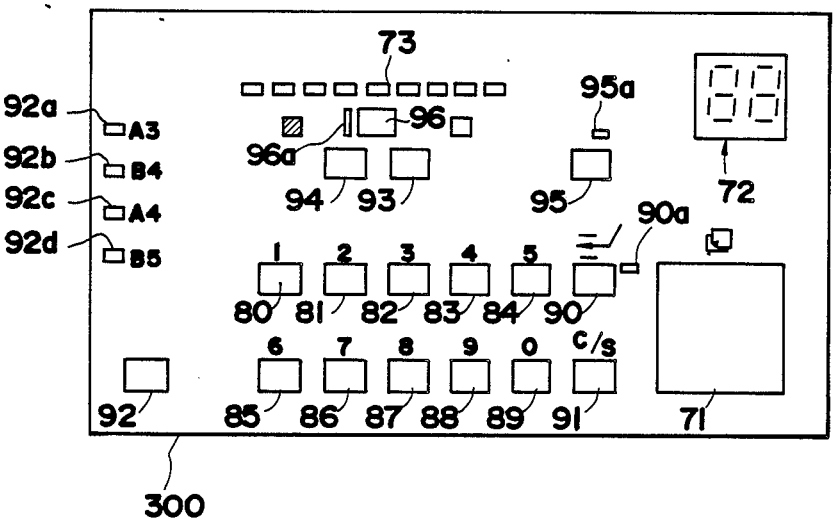
FIG. 2 is a plan view showing the operation panel of the copying machine.

On the other hand, an operation panel 300 is provided on the top of the copying machine 100. With reference to FIG. 2, arranged on the operation panel 300 are a paper cassette selecting switch 92 for determining which of the cassettes installed is to be selected to use the paper therein for copying operation, paper size displays 92*a* to 92*d* for showing the sizes of paper contained in the installed cassettes 20, 23 and also for indicating the paper size selected by the switch 92, and a copy button 71. The number of displays 92*a* to 92*d* provided is equal to the number of cassettes which can be attached to the machine body, i.e., the number of different paper sizes available. FIG. 2 also shows a display 72 for showing, for example, the number of copies to be made, exposure level display 73, number entry keys 80 to 89 for entering the number of copies or the like, interrupt key 90, display 90*a* therefor, clear/-stop key 91, up key 93 and down key 94 for manual exposure adjustment, memory key 95, display 95*a* therefor, automatic exposure mode key 96, and display 96*a* therefor.

Figure 4:
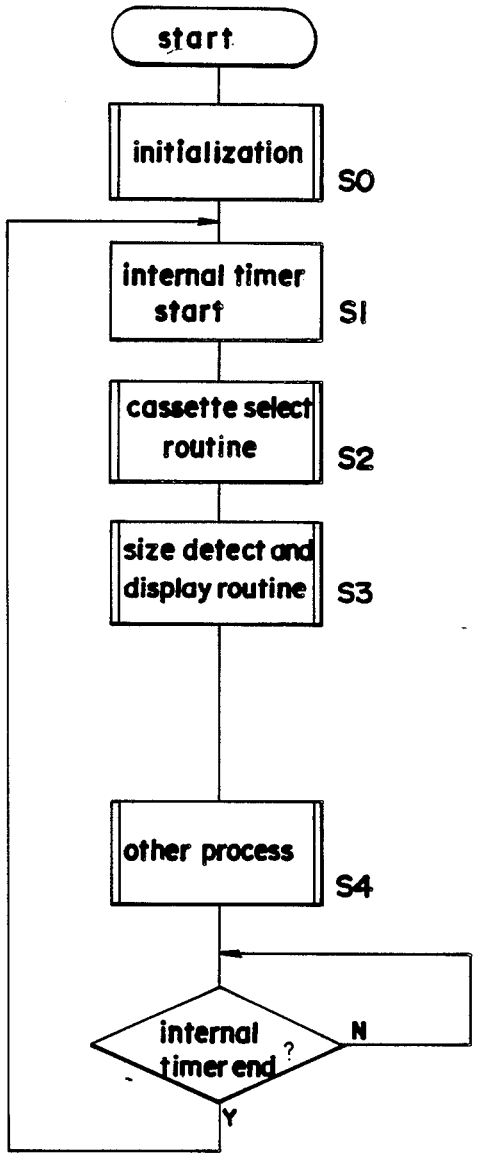
FIG. 4 is a flow chart showing the main routine of a process for controlling the machine.

FIG. 4 is a flow chart showing the main routine of the control process for the copying machine of the present embodiment.

After the power supply has been turned on, the microprocessor 201 is set to the initial state (step S0), whereby all the items to be controlled are initialized. For example, the number of copies to be made is set to 1, and the optical system is returned to the start position.

Next, the internal timer to be used for the control routine is set (step S1).

The following step S2 processes the selection of a cassette by the cassette selecting switch 92.

The size of the paper contained in each of the cassettes 20 and 23 is detected and the detected paper size is displayed in step S3.

The subroutines of these steps S2 and S3 will be described later with reference to FIGS. 5 to 9.

Step S4 processes the input signals from keys on the operation panel 300, for example, for setting and displaying the number of copies to be made, and the overall control process for copying operation.

After the completion of the foregoing steps, the internal timer previously set is checked for the count (step S5). Upon the timer counting up a predetermined value (i.e. upon the lapse of a predetermined period of time), the sequence returns to step S1 again to set the internal timer. Subsequently, the steps described are repeated.

Step 2 for the selection of cassette will be described in greater detail with reference to FIG. 5.

Incidentally, in the initial state following the turning on of the power supply, the cassette selecting switch 92 is not manipulated yet, so that this step is skipped to perform the next step S3.

Step S400 inquires whether the cassette selecting switch 92 has been depressed. If the answer is affirmative, steps S401 et seq. are performed.

Step S401 is followed by step S402 only upon the printing start switch 71 changing from off state to on state (on edge).

Steps S402, S403 and S404 effect a change-over from the selected cassette to the other cassette. When the upper cassette is the currently selected one, the lower cassette is selected. If otherwise, the upper cassette is conversely selected.

In step S405, a timer T-DSP (corresponding to a flickering period) is set for displaying by flickering the size of the paper in the selected cassette as will be described later (see FIG. 8). A flag F-DSP for indicating whether the flickering display is to be turned on or off is reset to 0 in step S406 to turn off the display.

Figure 6:
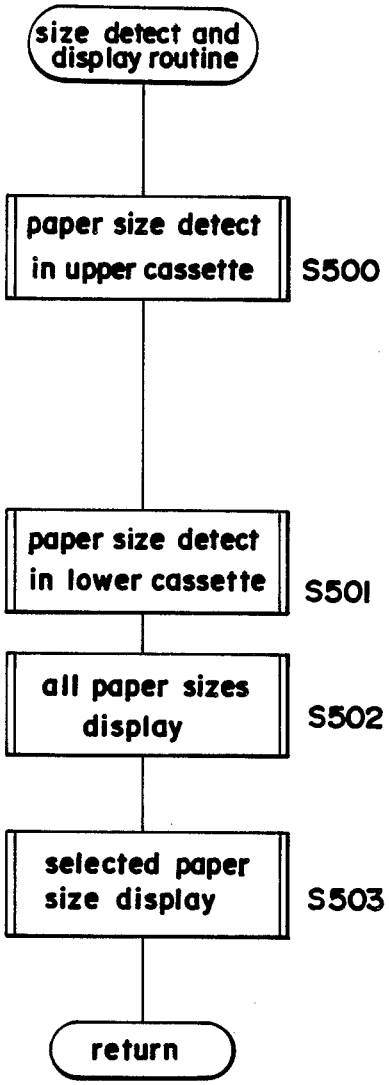

The next step S3 of the main routine will be described in detail with reference to FIG. 6. This step is performed to detect the sizes of the paper set in the cassettes, to display the detected paper sizes and to display the size of the paper set in the selected cassette by flickering.

In the initial state following the turning on of the power supply, the main step S1 is followed directly by step S3 as already mentioned.

In step S500, the paper size of the upper cassette is detected from the output from the detecting circuit 100. Like step S500, step S501 detects the paper size of the lower cassette from the output from the detecting circuit 200.

In step S502, the size displays are turned on for the paper sizes of the upper and lower cassettes detected in steps S500 and S501, as will be described in detail with reference to FIG. 7.

Step S503 is performed only when the cassette selecting switch 92 is depressed in the cassette selecting routine, to flicker the paper size display corresponding to the size of the paper set in the cassette which is selected by the switch 92. This step will be described in detail with reference to FIG. 8.

Figure 7:
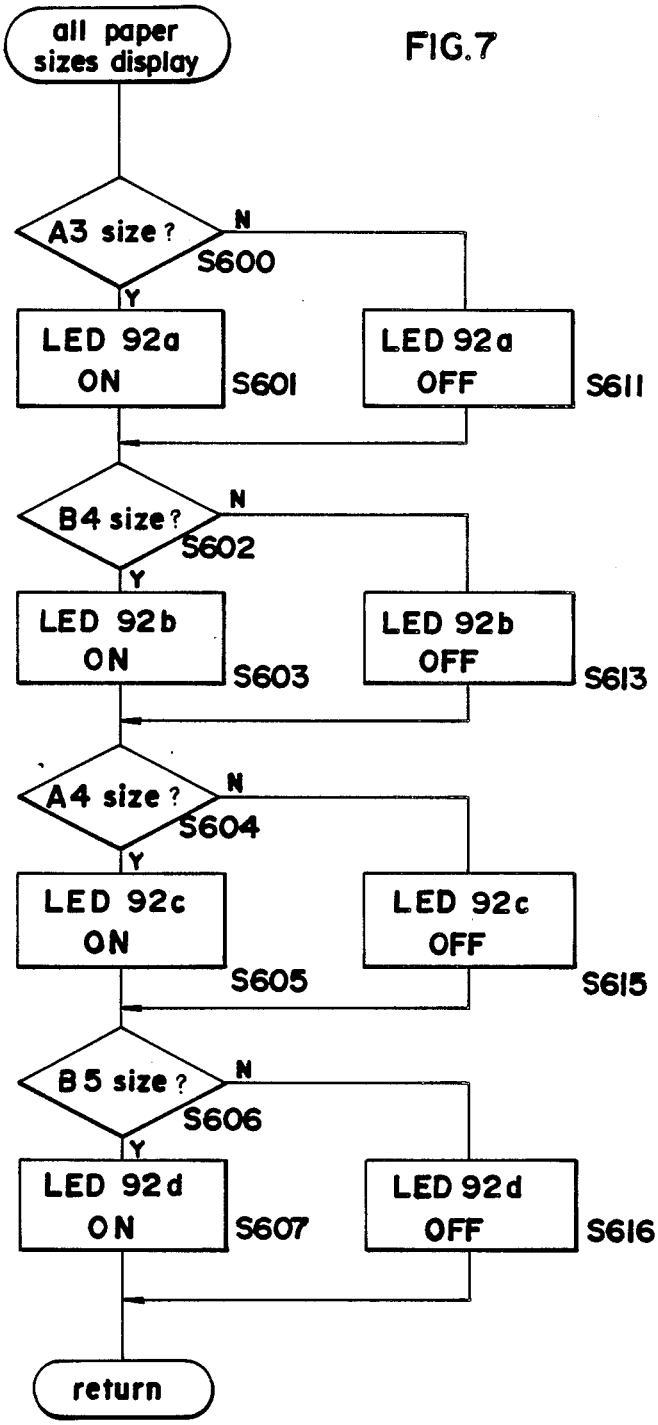

As already stated, FIG. 7 is a flow chart showing the process for turning on the paper size displays for the detected paper sizes.

Step S600 checks the paper size of the upper or lower cassette as to whether it is A3. When paper of A3 size is set in the upper or lower cassette, the A3 size display 92*a* is turned on step S601. If the paper is set in neither of these cassettes, the A3 size display 92*a* is turned off.

Steps S601 et seq. are similarly performed for B4, A4 and B5 sizes.

Figure 8:
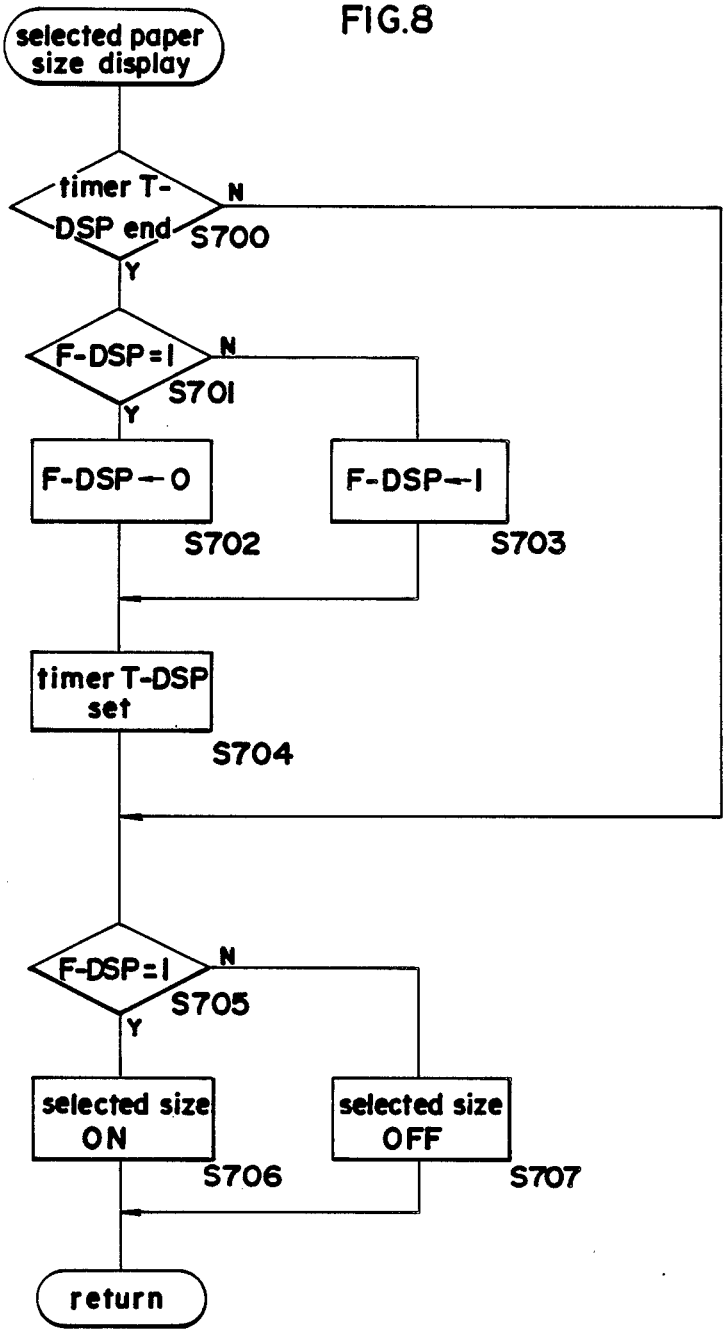

FIG. 8 is a flow chart showing the process for displaying (by flickering) the size if the paper set in the selected cassette.

Figure 5:
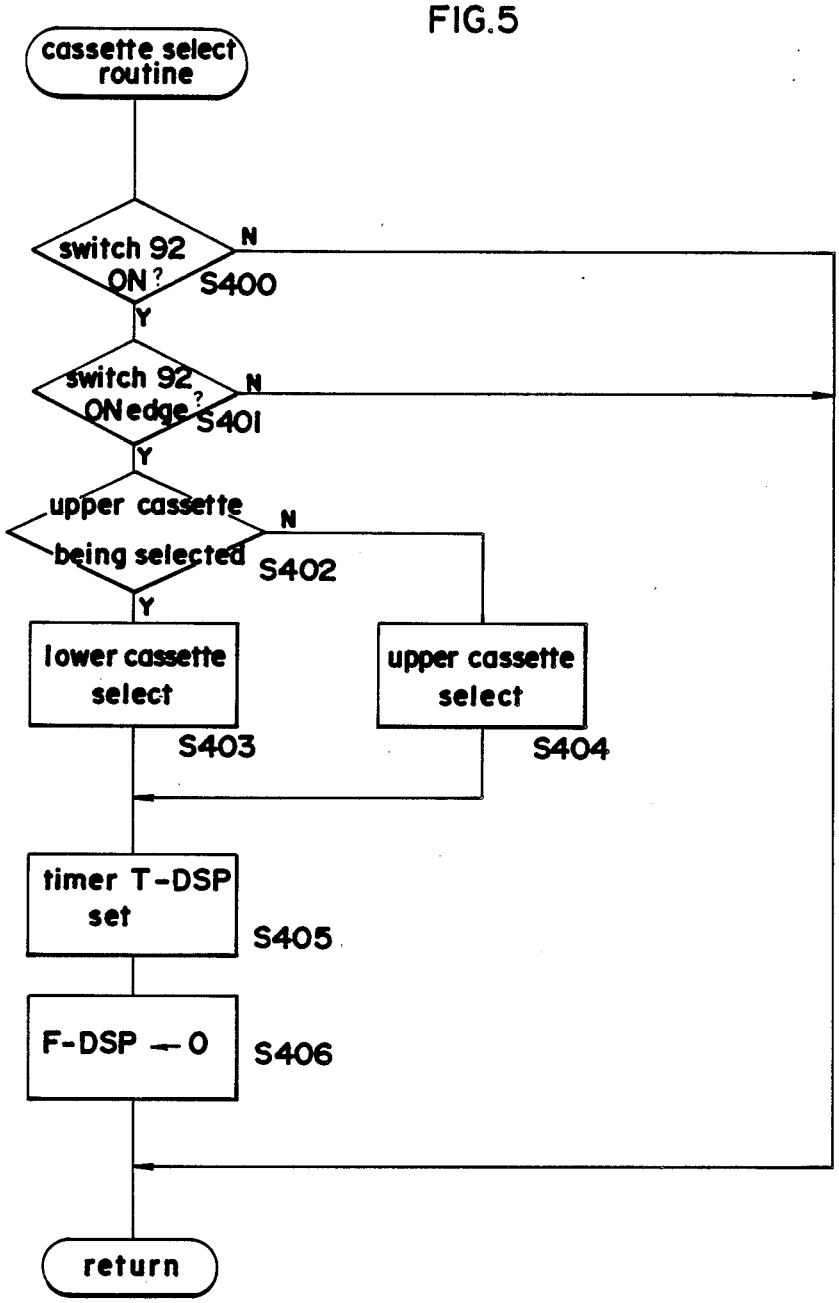
FIGS. 5 to 8 are flow charts showing the subroutines of the same.

Step S700 checks the timer T-DSP set in step S405 in FIG. 5 or step S704 as to its count and the completion of its operation. Step S701 follows if the counting operation has been completed.

Step S701 checks the flag F-DSP indicating whether the paper size display for the selected cassette is to be turned on or off as already stated.

The flag F-DSP, when found to be 1, is reset to 0 in step S702, whereas if F-DSP=0, the flag is set to 1 in step S703.

The flickering display timer T-DSP is set again in step S704. In steps S705, S706 and S707, the state of the flag F-DSP is checked to turn on the paper size display for the selected cassette when F-DSP=1 or to turn off the display if F-DSP=0. In this way, the paper size display for the selected cassette is repeatedly turned on and off every time the timer T-DSP is set to flicker the display. The flickering display indicates that the size thereby represented is the paper size of the currently selected cassette.

According to the present invention, the paper size of the selected cassette is displayed as distinguished from the other sizes, and flickering display is used as one mode of display for this purpose.

In place of the flickering display, two-color LEDs may be used to display the sizes of paper in the cassettes in one color and the paper size of the selected cassette in the other color.

With the embodiment described above, the size displays for the sizes of the paper loaded in the machine at all times are on, and among these displays, the one for the selected paper size is flickered. However, for example in multicopying operation during which the paper size is not changeable, the size display for the selected paper size only may be turned on to avoid the possible recognition error. Stated more specifically, during a period of time after the start of multicopying operation, the displays concerned are turned on in the usual mode along with flickering as in the above embodiment, and only the size display for the selected paper size is thereafter held on with the other display turned off. After the completion of a multicopying operation or after autoresetting, the size displays for the loaded paper sizes are turned on, with the display for the selected paper size flickered.

Furthermore, the combination of switches and contacts used for detecting the paper size may be replaced by magnetic sensors and magnets. Alternatively, a partition plate which is shiftable within the cassette according to the paper size may be used to detect the paper size from the position of the plate.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper size selecting device for use in a recording apparatus loadable with paper of different sizes selectively, said device comprising:

means for detecting the size of paper loaded in the apparatus;

key input means for selecting a desired size;

means for displaying the respective sizes of paper loadable in the recording apparatus, said display means being selectively operable in a first display state indicating that the paper of the size concerned is loaded in the recording apparatus or in a second display state indicating that the paper of the size concerned has been selected; and control means for bringing the display means into the first display state in response to an output from the size detecting means and changing means for changing over the display member from the first display state to the second display state in response to an output from the size selecting key input means.

2. A paper size selecting device as claimed in claim 1, said detecting means includes a paper cassette prepared specifically for each of different paper sizes and a sensor means for distinguishing the cassette.

3. A paper size selecting device as claimed in claim 1, wherein said display means includes a plurality of display members, each of which is kept lighted in the first display state whereas said display member is flickering in the second display state.

4. The recording apparatus of claim 1 further including means for disabling the display of the paper sizes other than the specific paper size currently being enabled after a predetermined time from the start of a copying operation.

5. A paper size selecting device for use in a recording apparatus loadable with paper of different sizes selectively, said device comprising:

means for detecting the size of paper loaded in the apparatus;

key input means for selecting a desired size;

a plurality of display members for providing the respective sizes of paper loadable in the recording apparatus;

first drive means for driving, in response to an output from the size detecting means, some of the display members in a first display state to display that the paper of the size concerned is loaded in the recording apparatus, and second drive means for driving, in response to an output from the size selecting key input means, one of said display members driven by said first drive means in a second display state different from the first display state to display that the paper of the size concerned has been selected.

6. A paper size selecting device as claimed in claim 5, wherein the first drive means drives the display member in one color while the second drive means drives the display member in another color.

7. A paper size selecting device for use in a recording apparatus loadable with paper of different sizes selectively, said device comprising:

means for detecting the size of paper loaded in the apparatus;

key input means for selecting a desired size;

a plurality of display members provided for the respective sizes of paper loadable in the recording apparatus;

a drive means for driving some of the display members corresponding to the paper size detected by the detecting means, and a changing means for changing a driving state of the display member corresponding to the paper size selected by the size selecting key input means.

8. A paper size selecting device as claimed in claim 7, further including means for disabling the display of the display members other than the display member corresponding to the paper size selected by the size selecting key input means after a predetermined time from a copy starting operation.

9. A paper size selecting device for use in a recording apparatus loadable with paper of different sizes selectively, said device comprising;

means for detecting the size of paper loaded in the apparatus;

means for displaying the sizes of paper loaded in the recording apparatus based on an output from the size detecting means;

input means for selecting a desired size, and means for changing a display state of the display means so as to indicate the paper size selected by the input means.

* * * * *